US008550460B2

(12) United States Patent
Berni

(10) Patent No.: US 8,550,460 B2
(45) Date of Patent: Oct. 8, 2013

(54) APPARATUS AND METHOD FOR TRANSPORTING FLEXIBLE, PLANAR PRODUCTS

(75) Inventor: Claudio Berni, Hombrechtikon (CH)

(73) Assignee: Ferag AG, Hinwil (CH)

( * ) Notice: Subject to any disclaimer, the term of this patent is extended or adjusted under 35 U.S.C. 154(b) by 133 days.

(21) Appl. No.: 13/099,982

(22) Filed: May 3, 2011

(65) Prior Publication Data

US 2011/0272249 A1 Nov. 10, 2011

(30) Foreign Application Priority Data

May 10, 2010 (CH) ..... 0716/10

(51) Int. Cl.
*B65H 5/08* (2006.01)
*B65H 29/04* (2006.01)

(52) U.S. Cl.
USPC ..... 271/277; 271/3.23; 271/5; 198/470.1; 198/579; 198/689.1

(58) Field of Classification Search
USPC ..... 198/470.1, 576, 579, 678.1, 689.1, 198/803.3; 271/3.23, 5, 82, 204, 277
See application file for complete search history.

(56) References Cited

U.S. PATENT DOCUMENTS 3,282,586 A 11/1966 Schwebel
4,565,363 A 1/1986 Faltin
4,799,664 A 1/1989 Burger
5,028,045 A 7/1991 Muller
5,046,711 A * 9/1991 Merwarth et al. ..... 271/11
5,075,734 A * 12/1991 Durland et al. ..... 399/305
5,107,656 A * 4/1992 Katz et al. ..... 53/131.4
5,236,188 A * 8/1993 Breton et al. ..... 271/187
5,356,128 A 10/1994 Eberle et al.
5,388,820 A * 2/1995 Eberle et al. ..... 271/277
5,395,151 A 3/1995 Eberle
5,660,382 A * 8/1997 Meier ..... 270/52.16
5,664,770 A * 9/1997 Keller ..... 271/3.11
5,793,397 A * 8/1998 Barker et al. ..... 347/88

(Continued)

FOREIGN PATENT DOCUMENTS

EP 0 557 679 A1 9/1993
EP 0 557 680 A1 9/1993

(Continued)

OTHER PUBLICATIONS

International Search Report, mailed Oct. 8, 2010, of Swiss Priority Application No. 2010 0716/10, filed May 10, 2010.

*Primary Examiner* — Douglas Hess
(74) *Attorney, Agent, or Firm* — Alston & Bird LLP

(57) ABSTRACT

Printed products (10) are conveyed to a transfer portion (22) by means of the grippers (14) of the gripper conveyor (12). The vacuum belt conveyor (26) suctions with its active strand (28) the respective end region (32) of the printed products (10), after which, close to the end of the (34) of the transfer portion (22), the grippers (14) respectively release the printed products (10). The motional path (38) of the gripper jaws (16) runs in the transfer portion (22) in the shape of an arc. The active strand (28) of the vacuum belt conveyor (26) runs in the transfer portion (22) at an approximately constant distance to the motional path (38). In the case of large processing capacities and correspondingly high velocities, a reliably secure, positionally stable transfer of the printed products (10) from the gripper conveyor (12) to the vacuum belt conveyor (26) is thereby ensured.

16 Claims, 10 Drawing Sheets

(56) References Cited

U.S. PATENT DOCUMENTS

| | | | | |
|---|---|---|---|---|
| 6,648,198 | B2 | 11/2003 | Demers | |
| 6,698,749 | B2 * | 3/2004 | Muller | 271/99 |
| 6,722,494 | B2 * | 4/2004 | Nakakado | 198/792 |
| 6,773,008 | B2 | 8/2004 | Eberle | |
| 6,976,674 | B2 * | 12/2005 | Honegger | 271/204 |
| 7,004,463 | B2 * | 2/2006 | Eugster et al. | 271/187 |
| 7,150,454 | B2 * | 12/2006 | Honegger | 271/204 |
| 7,597,325 | B2 | 10/2009 | Maierhofer et al. | |
| 7,757,461 | B2 | 7/2010 | Honegger | |
| 7,877,965 | B2 | 2/2011 | Honegger | |
| 8,181,959 | B2 * | 5/2012 | Bichsel et al. | 271/306 |
| 2002/0125629 | A1 | 9/2002 | Keller | |
| 2003/0188615 | A1 | 10/2003 | Ripley | |
| 2005/0012265 | A1 | 1/2005 | Berlingen et al. | |

FOREIGN PATENT DOCUMENTS

| | | | |
|---|---|---|---|
| EP | 0 600 183 | A1 | 6/1994 |
| EP | 1 493 701 | A1 | 1/2005 |
| FR | 2 740 122 | | 4/1997 |
| WO | WO 2009/015503 | A1 | 2/2009 |

* cited by examiner

APPARATUS AND METHOD FOR TRANSPORTING FLEXIBLE, PLANAR PRODUCTS

CROSS-REFERENCE TO RELATED APPLICATIONS

This application claims priority to Swiss Application No. 2010 0716/10, filed May 10, 2010.

BACKGROUND OF THE INVENTION

The present invention relates to an apparatus and a method for transporting flexible, planar products, as claimed in patent claims 1 and 13 respectively.

In particular in mailrooms of printing houses, the printed products are frequently transported by means of gripper conveyors. In this context, it frequently happens that the printed products are delivered from the gripper conveyors to the belt conveyor for further processing. In the case of large processing capacities and the high conveying velocities associated therewith, the problem exists that the printed products flap when transferred from the gripper conveyor to the belt conveyor and, in particular, behave erratically after being released by the grippers of the gripper conveyors, with the risk of losing their ordered arrangement.

BRIEF SUMMARY OF THE INVENTION

An object of the present invention is therefore to provide an apparatus and a method for transporting flexible, planar products, which apparatus/method ensures a secure and reliable transfer of the products from a gripper conveyor to a belt conveyor, even at high conveying velocities.

This object is achieved with an apparatus having the features of patent claim 1 and a method having the features of patent claim 13.

The grippers of the gripper conveyor are designed to, with their gripper jaw, hold and transport a flexible, planar product, in particular a printed product such as a newspaper, a magazine or the like, by its holding region, which lies contiguous to a holding edge. Since the products are secured in the gripper jaw, they have a precisely defined position. According to the invention, the motional path of the gripper jaws, i.e. of the free end of the gripper jaws, has in a transfer portion, in which the products are transferred from the gripper conveyor to a belt conveyor, an arc-shaped course. The course may be arc-shaped over the whole of the transfer portion.

The grippers can respectively be loaded with a single product. It is also possible, however, for the grippers to be loaded with more than one product, for example two products, these products being arranged in an imbricated formation, so that the holding regions of the products are exposed.

According to embodiments of the invention, the belt conveyor is configured as a vacuum belt conveyor having a perforated belt, the active strand of which runs in the transfer portion at a distance to the motional path of the gripper jaws.

The arc-shaped course of the motional path of the gripper jaws leads to a secure bearing contact of the products, with their free end region facing away from the holding edge, against the active strand of the vacuum belt conveyor. The vacuum belt conveyor suctions the end region of the particular products to the active strand, whereby said products are stabilized and held in a defined position, so that, when the particular grippers are subsequently opened, they can no longer alter this position.

Since the motional path of the gripper jaws has an arc-shaped course and the active strand of the vacuum belt conveyor runs in the transfer portion at a distance to the motional path, the mutual spacing of the products, or the overlapping thereof, is also altered in the course of the transfer. If the arc-shaped course of the motional path is convex, the distance between the free end edges of successive products, which free end edges lie opposite the holding edges of the products, is increased. Correspondingly, this distance is reduced in the case of a concave course.

Vacuum belt conveyors have at least one self-contained perforated belt, which is driven such that it rotates in the direction of conveyance and the holes of which, in the suction portion of the active strand, are connected to a vacuum source. The suction portion can here extend around virtually the entire length of the active strand. It is also possible, however, for the suction portion to be divided, in the direction of conveyance, into successive sub-portions.

Usually, vacuum belt conveyors are provided with a vacuum pan, which is connected to the vacuum source and over whose opening the active strand of the perforated belt is moved. The holes of the perforated belt which are respectively located in the region of the opening are hence connected to the vacuum source.

The gripper jaws have in the transfer portion a speed—measure of their vectorial velocity—which, according to embodiments of the invention, is less than the speed—and thus the rotational velocity—of the perforated belt.

The active strand may have in the transfer portion an at least approximately arc-shaped course which is equidirectional to the motional path. An at least approximately arc-shaped course means that the arc can be imitated also by successive, chord-like portions.

In an embodiment of the apparatus according to the invention, the motional path of the gripper jaws has in the transfer portion, and preferably over the entire length of the transfer portion, a circular-arc shaped course. The distance between the products, or their free end edges, in the transfer portion hence remains at least approximately constant.

The distance between the motional path of the gripper jaws and the active strand of the vacuum belt conveyor may be adjustable. The optimal processing of printed products of different thickness and different length is thereby made possible.

In a further embodiment of the apparatus according to the invention, the clamping tongues of the grippers, which respectively form a gripper jaw, and thus the gripper jaws per se, are mounted pivotably about a gripper axis running transversely, in particular at right angles, to the direction of conveyance. This makes it possible, for example by means of a link motion, to control the desired pivotal position of the gripper jaws upon reaching the transfer portion, and within this. More particularly, the gripper axis runs parallel to the conveying surface defined by the vacuum belt conveyor.

The gripper jaws, upon reaching the transfer portion and within the transfer portion, can be directed obliquely rearward with respect to the direction of conveyance. The free end edge of the products is hence trailing with respect to their holding edge located in the gripper jaw.

The gripper conveyor may have a conveying member guided in a guide channel. This is in the form of a link chain in one embodiment, which is capable of withstanding tensile and compressive load. On the conveying member, cantilever-like carrying members are arranged at a predetermined carrier spacing, which carrying members reach through the gap of the guide channel of C-shaped cross section. These carrying members respectively carry, outside the guide channel, a gripper. In such an embodiment, the exact position and location of each product, and thus the location of the products relative to one another, is always predefined and known.

In an embodiment of the apparatus according to the invention, in the transfer portion the motional path of the gripper jaws is convex and, correspondingly, the active strand of the vacuum belt conveyor is concave. This embodiment allows the centrifugal forces to be utilized, which force the free end region of the products into bearing contact against the active strand of the vacuum belt conveyor.

If, in such an embodiment, the motional path of the gripper jaws, in the transfer portion, is located radially on the outside with respect to the conveying member to which the grippers are fastened by carrying members, the distance between the free end edges of the successive products in relation to the carrier spacing, and thus to the distance which these end edges adopt in a rectilinear course of the gripper conveyor, is additionally increased.

The active strand may be divided in the transfer portion into rectilinear segments, which succeed one another in the direction of conveyance, and thus forming chords of the arc, allow a concave course of the active strand in the transfer portion. This embodiment offers the possibility, between successive segments, of holding the perforated belt radially to the outside with respect to the arc.

At least some of the segments are assigned a vacuum pan, which is connected to a vacuum source and over which runs the active strand. At least those segments which are located in the suction portion of the vacuum belt conveyor are configured in this way. All—possibly apart from the first or the last segment, viewed in the direction of conveyance—may be realized in this way.

The perforated belt can be guided between respectively successive segments in a Ω shape around deflexion rollers. This allows a low-friction operation.

Moreover, the perforated belt is shored in the region of the vacuum pans, by means of supporting rollers, against the movement into the vacuum pans.

In a further embodiment of the apparatus according to the invention, the vacuum belt conveyor has, in addition to the perforated belt, at least one further perforated belt driven at the same speed, preferably one on each of the two sides. The segments of the further perforated belt or belts are preferably arranged offset, in the direction of conveyance, in relation to the segments of the perforated belt, so that the region between successive segments of the perforated belt is bridged by a segment of the further perforated belt or belts. Uninterrupted holding of the end regions of the products, despite segmentation of the active strand, is thereby ensured.

In the transfer portion, the motional path of the gripper jaws can be shaped concavely and the active strand of the vacuum belt conveyor correspondingly convexly. A rectilinear course of the active strand is also conceivable. In these embodiments, segmentation of the vacuum belt conveyor is unnecessary.

It should be mentioned that the distance between the motional path of the gripper jaws and the active strand of the vacuum belt conveyor prevents the formation of a nip for the products. The transfer portion is thus nipless. The distance is greater than the thickness of the products and, should these overlap, greater than the overall thickness of the overlapping products.

In the method according to embodiments of the invention, a flexible, planar product is transported by means of a gripper conveyor into a transfer portion. To this end, the product is secured, by a holding region of the product, in the gripper jaw of grippers arranged one behind another. The grippers arranged one behind another are driven rotatingly in a direction of conveyance F. The product transported into the transfer portion is in this portion, in an end region facing away from its holding region, suctioned by an active strand, driven in the direction of conveyance F, of a perforated belt of a vacuum belt conveyor. After the product, in its end region, has been suctioned to the active strand of the vacuum belt conveyor, the grippers of the gripper conveyor open and the product is transported onward by means of the vacuum belt conveyor. The active strand here runs at a distance A to the motional path of the gripper jaws. The motional path of the gripper jaws has an arc-shaped course. The perforated belt is driven at a belt speed which is greater than the speed at which the gripper jaws are driven.

In embodiments of the method, in the transfer portion the active strand runs in the same direction as the motional path of the gripper jaws and at least approximately in an arc shape.

In further embodiments, the motional path of the gripper jaws in the transfer portion runs in the shape of a circular arc.

In a further embodiment of the method, the motional path of the gripper jaws runs convexly and the active strand of the vacuum belt conveyor runs concavely.

BRIEF DESCRIPTION OF THE SEVERAL VIEWS OF THE DRAWINGS

The invention is explained in greater detail with reference to an illustrative embodiment represented in the drawing, wherein, purely schematically.

DETAILED DESCRIPTION OF THE INVENTION

Figure 1:
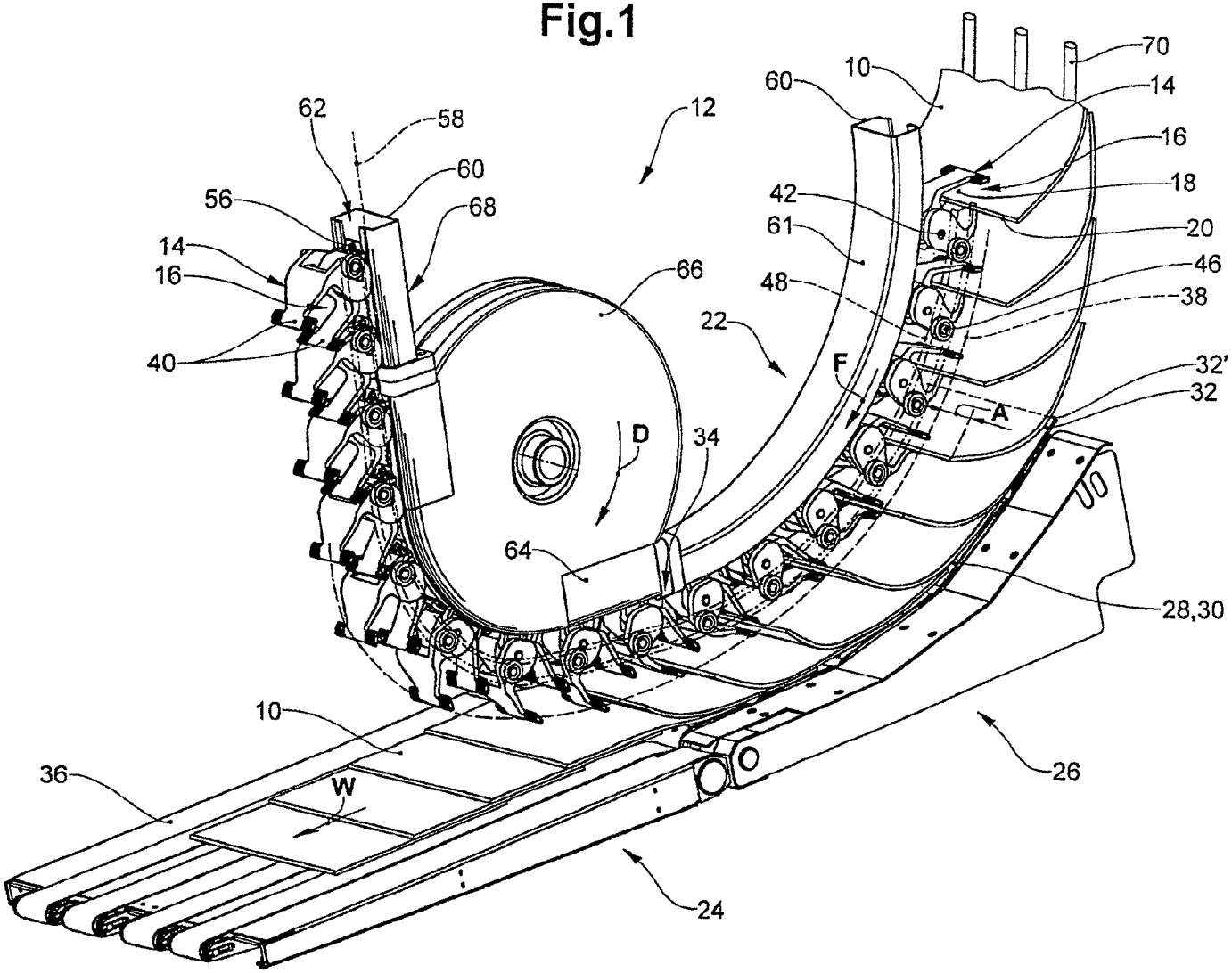
FIG. 1 shows in a perspective, oblique top view a part of an apparatus according to the invention, comprising a gripper conveyor, which transports printed products to a transfer portion, and an evacuation conveyor, which in the transfer portion is configured as a vacuum belt conveyor to take up and carry off the supplied printed products.

FIG. 1 shows a region, relating to the present invention, of an apparatus for transporting flexible, planar products 10, in the present case printed products such as newspapers, magazines or the like. It has a gripper conveyor 12, serving as a feed conveyor, whose grippers 14, which are driven rotatingly in a direction of conveyance F and are arranged one behind another, are designed to, with their gripper jaw 16, respectively secure a product 10 by its holding region 18 adjoining a holding edge 20 and transport it to a transfer portion 22.

Arranged downstream of the gripper conveyor 12 is an evacuation conveyor 24 configured as a belt conveyor, which in the transfer portion 22 is configured as a vacuum belt conveyor 26. The vacuum belt conveyor 26, which is disposed in the transfer portion 22 beneath the gripper conveyor 12, is designed to, in the transfer portion 22, with its active strand 28 of the perforated belt 30, which active strand 28 is driven in the direction of conveyance F, suction the products 10, held by the gripper conveyor 12, in their end region 32 facing away from the holding edge 20 and, following subsequent release by the grippers 14, transport them onward. The release takes place close to the downstream-situated end 34 of the transfer portion 22 and the vacuum belt conveyor 26 conveys the received products 10 to a belt conveyor 36 of the evacuation conveyor 24, which belt conveyor 36 is arranged downstream of the first-named conveyor in the direction of conveyance F and is provided with parallel conveyor bands.

The motional path 38 of the gripper jaws 16 has in the transfer portion 22 an arc-shaped course, in the illustrative embodiment represented in the drawing a circular-arc-shaped course which is convex with respect to the self-enclosed gripper conveyor. The vacuum belt conveyor 26 is arranged radially on the outside with respect to the arc of the gripper conveyor 12 such that the active strand 28 in the transfer portion 22 has an at least approximately constant distance A to the motional path 38.

Each gripper 14 has two interacting clamping tongues 40 forming the gripper jaw 16, one of the clamping tongues 40, in the present case the leading one viewed in the direction of conveyance F, determining the pivotal position of the grippers 14 and thus of the gripper jaw 16, and the other, trailing clamping tongue 40 being pivoted relative to the leading clamping tongue 40 for the opening and closing of the gripper jaw 16.

The motional path 38 is given by the movement of the free end of the clamping tongue 40 defining the position of the grippers 14, in the shown illustrative embodiment of the leading clamping tongue 40.

At this point it should be noted that the distance A between the motional path 38 and the vacuum belt conveyor 26 is greater than the thickness of the products 10 to be conveyed, and should these overlap, as in the shown illustrative embodiment, greater than the overall thickness of the products 10 in the region of overlap. The products 10 are thus, in the transfer portion 22, not held in a nip.

In particular, embodiments as are known, for example, from printed publications EP 0 600 183 A1, EP 0 557 680 A1 and EP 0 557 679 A1 are suitable as grippers 14. The clamping tongues 40, which respectively form a gripper jaw 16, can be pivoted relative to one another about a gripper axis 42 running at right angles to the direction of conveyance F and parallel to the conveying surface defined by the vacuum belt conveyor 26 and, in the closed setting of the gripper jaw 16, are locked under spring load by means of a locking lever 44, see FIG. 3.

One of the clamping tongues 40, in the present case the one which is leading in the direction of conveyance F, is fixedly connected to a positioning follower roller 46, which is guided in a positioning link 48 to control the rotational position of the grippers 14 and thus of the gripper jaw 16.

Figure 3:
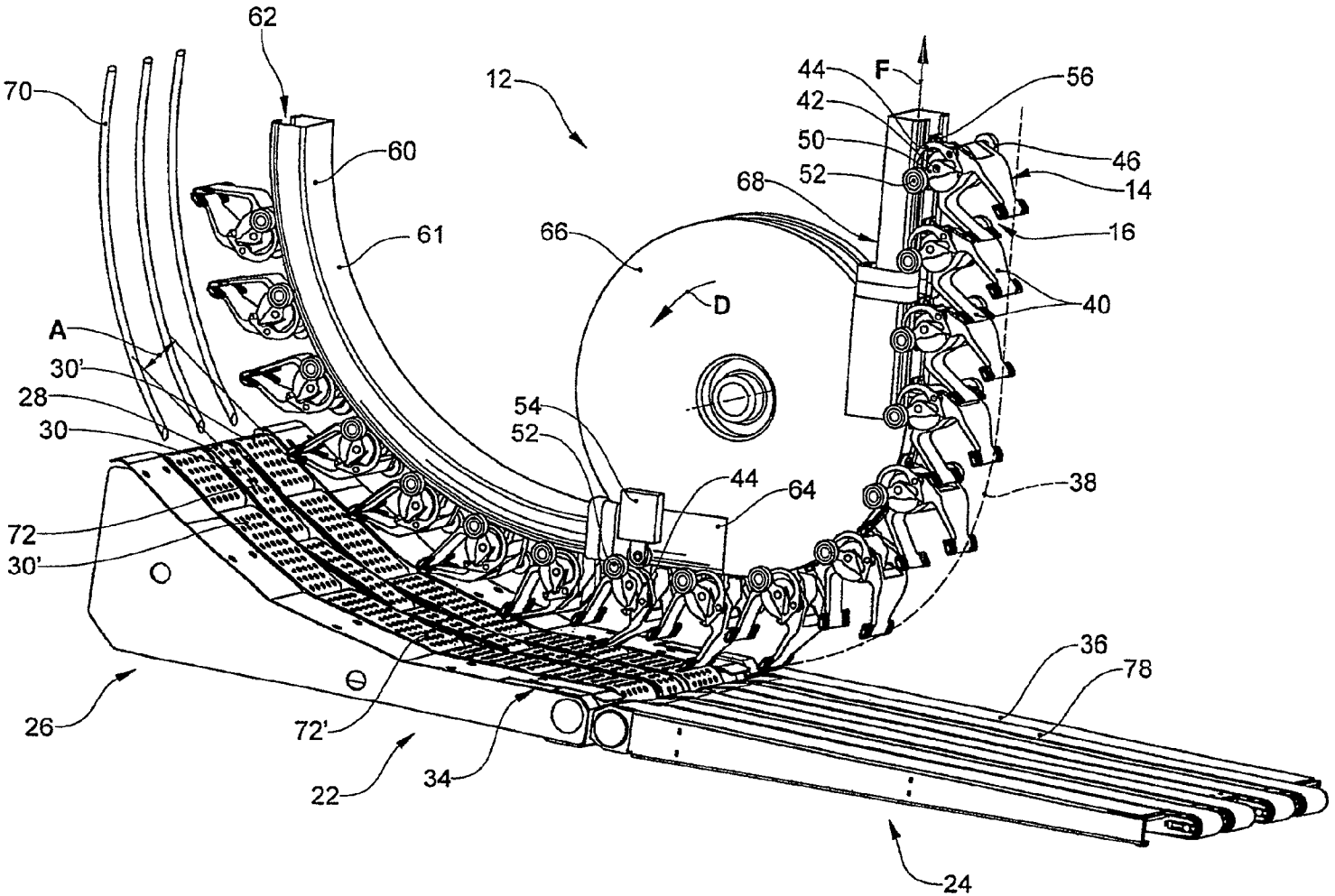
FIG. 3 shows in perspective representation from obliquely above the rear side of that region of the apparatus which is shown in FIGS. 1 and 2.

The other one of the clamping tongues 40, in the shown illustrative embodiment the one which is trailing in the direction of conveyance F, is connected by a spring to a closing lever 50, which on the one hand bears a follower roller 52, mounted such that it is freely rotatable, and, on the other hand, is designed to interact with the locking lever 44; see FIG. 3.

For the closing of the grippers 14, or of the gripper jaw 16, the follower roller 52 is moved by means of a closing link (not shown) such that the clamping tongue 40 connected by the spring to the closing lever 50 is pivoted toward the other clamping tongue 40 held in its position by the positioning follower roller 46 and the positioning link 48, to be precise to the point where, following the bearing contact of the clamping tongues 40 one against another, or against a product 10 arranged therebetween, the spring is tensioned and the closing lever 50 is interlocked with the locking lever 44 for the generation of the clamping force. For the opening of the grippers 14, close to the end 34 of the transfer portion 22, the locking lever 44 is pivoted by means of an opening apparatus 54 such that it releases the closing lever 50 and the clamping tongue 40 connected thereto can move into the opening setting. The structure and the working method of such grippers 14 is explained in detail in the aforementioned printed publications and the pertinent disclosure should herewith be integrated into the present description.

For the sake of completeness, it should be mentioned that the opening apparatus 54 is arranged such that it opens the grippers 14 which are respectively moved past it, if the clamping tongue 40 which determines the motional path 38 is close to the downstream-situated end 34 of the transfer portion 22.

Each of the grippers 14 is fastened in a known manner to a cantilever-like carrying member 56. The carrying members 56, for their part, are fastened with a predetermined carrier spacing to a self-enclosed conveying member 58, which is preferably formed by a link chain capable of withstanding tensile and compressive load. The conveying member 58 is guided in a guide channel 60 of C-shaped cross section, the carrying members 56 reaching through the gap 62 of the guide channel 60, so that the grippers 40 are outside the guide channel 60; in the shown illustrative embodiment, with respect to the arc-shaped course, radially outside the guide channel 60.

Viewed in the direction of conveyance F, the guide channel 60, which in the shown region of the apparatus according to the invention extends in a vertical plane, runs vertically downward, then in a 90° circular-arc portion 61 through the transfer portion 22, the end 34 of the transfer portion 22 being followed by a short rectilinear portion 64. This leads the conveying member 58 tangentially up to a continuously driven deflexion and drive wheel 66 mounted on a horizontal axis. In an upward vertical direction, the deflexion and drive wheel 66 is followed, in turn, by a rectilinear portion 68 of the guide channel 60. The deflexion and drive wheel 66 driven in the rotational direction D drives the conveying member 58 and thus the grippers rotatingly in the direction of conveyance F.

The grippers 14 are aligned in their pivotal position by means of the positioning link 48 such that, upon reaching the transfer portion 22 and up to the end 34 thereof, the gripper jaws 16 are directed obliquely rearward with respect to the direction of conveyance F. Hence, the holding edges 20 of the products 10, with respect to the end edges 32' situated opposite them, are leading, and in the transfer portion 22 the holding edges 20, viewed in the radial direction, are located further in than the end edges 32' and the thereto adjoining end region 32.

In the shown illustrative embodiment, in the transfer portion 22, the pivotal position of the grippers 14 is maintained with respect to the direction of conveyance F, so that the motional path 38 runs at a constant distance to the guide channel 60 and thus, in the transfer portion 22, has a circular-arc-shaped course.

It should be mentioned that the gripper conveyor 12 is assigned guide rods 70, which at a fixed distance to the guide channel 60 and to the motional path 38, viewed in the direction of conveyance F, extend as far as the vacuum belt conveyor 26. The products 10 held by the grippers 40 slide with their end region 32 along these guide rods 70, which ensure that the products 10 maintain their obliquely rearward running, possibly curved position, as represented in FIG. 1, also in the vertically downward running portion and during standstill of the gripper conveyor 12.

The vacuum belt conveyor 26 is realized so as to be vertically adjustable in order to be able to adjust the distance A between the motional path 38 and the active strand 28, in dependence on the thickness of the products 10 to be processed.

The vacuum belt conveyor 26 has at least one self-enclosed perforated belt 30, which is driven such that the active strand moves in the direction of conveyance F at a rotational velocity and thus belt speed |w| which is greater than the speed |v| of the gripper jaws 14. In some embodiments, for the gripper jaws 14 and the active strand 28, the angular velocity ω, in the transfer portion 22, is at least approximately equal.

Figure 2:
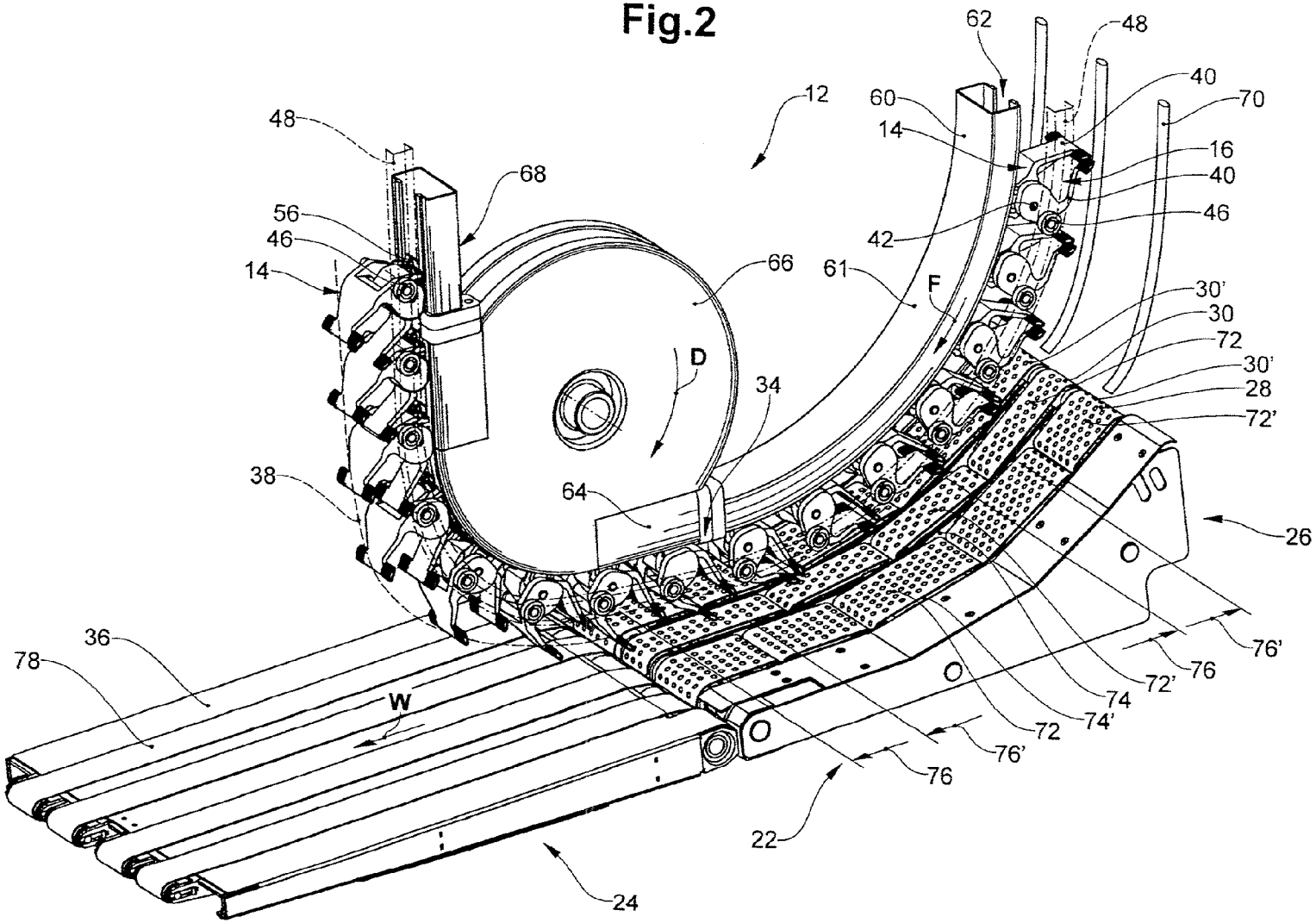
FIG. 2 shows in the same representation as FIG. 1 that region of the apparatus which is shown there, without printed products.

If a single perforated belt 30 is provided, this can be arranged symmetrically to the plane in which the motional plane 38 extends. If two perforated belts 30 are provided, one of the perforated belts 30 can be located on each side with respect to this plane. In particular, the vacuum belt conveyor 26 is configured as represented in FIGS. 2 and 3, with a perforated belt 30 in the middle and, on each side of this perforated belt 30, a further perforated belt 30'.

The active strand 28 of the centrally arranged perforated belt 30 is formed by four rectilinear, at least approximately equally long segments 72, which follow on from one another in the direction of conveyance F and which are arranged at angles to one another and, forming chords, imitate the concave arc. Viewed in the direction of conveyance F, the second, third and fourth segments 72 are respectively assigned a vacuum pan 74, as is described in greater detail further below. The first segment 72 thus serves exclusively for the guidance of the end regions 32 of the products 10, while the second, third and fourth segments 72 form a suction portion 76 of the active strand 28 of the perforated belt 30.

In the shown illustrative embodiment, the active strand 28 extends over an angle of about 40°.

The two further perforated belts 30' arranged to the side of the perforated belt 30 form in the region of the active strand 28, in a similar manner to the perforated belt 30, rectilinear segments 72', which succeed one another in the direction of conveyance F and are arranged at angles to one another in order, forming chords of the arc, likewise to imitate the concave course. The first and last segments 72', viewed in the direction of conveyance F, are configured roughly half as long as the particular segments 72 of the perforated belt 30, while the further three segments arranged between these segments 72' have roughly the same length as the segments 72 of the perforated belt 30.

The segments 72' of the further, likewise self-enclosed perforated belts 30' thus bridge the short gaps between the segments 72 of the perforated belt 30, and the segments 72 correspondingly bridge the short gaps between the successive segments 72' of the further perforated belts 30'.

As is additionally described further below, the middle three segments 72' of the further perforated belts 30 are respectively assigned a vacuum pan 74'. The suction portion 76' of the active strand 28 of the further perforated belts 30' thus lies in the region of the middle three segments, while the respectively first segment 72' and last segment 72', viewed in the direction of conveyance F, serve for the guidance of the end regions 32 of the products 10.

Figure 4:
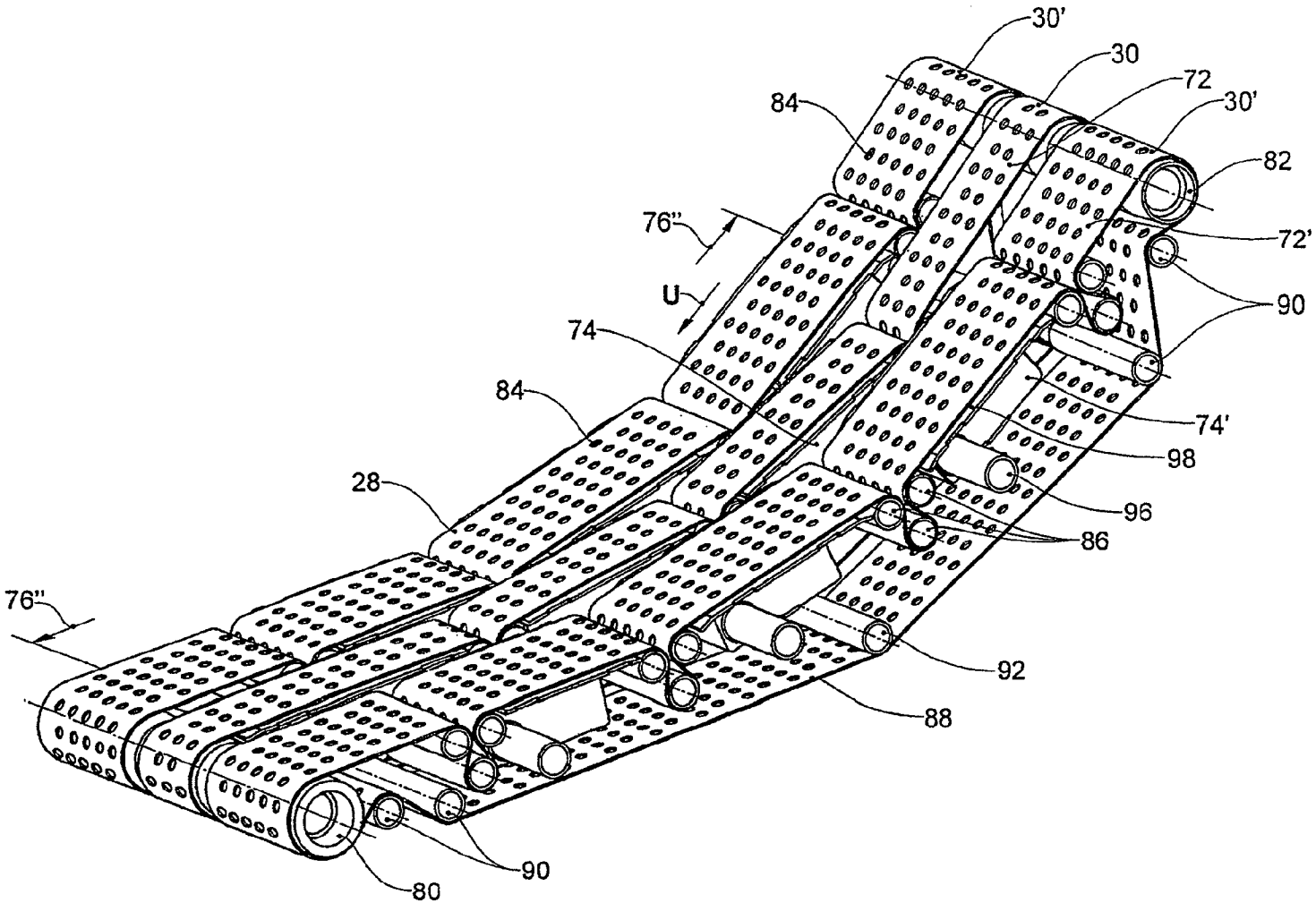
FIG. 4 shows in the same perspective representation as FIGS. 1 and 2 three mutually adjacent perforated belts of the vacuum belt conveyor, with corresponding vacuum pans.

The suction portion 76" of the vacuum belt conveyor 26—see also FIG. 4—formed by a combination of the suction portions 76 and 76' of the first perforated belt 30 and of the further perforated belts 30', thus extends, viewed in the direction of conveyance F, from approximately the middle of the first segment of the perforated belt 30 to toward the end of the last segment 72 of this perforated belt 30.

The vacuum belt conveyor 26 is directly followed, in the direction of conveyance F, by the belt conveyor 36, which, in the shown illustrative embodiment, has four conveying bands 78, which are arranged side by side and are driven at the same velocity as the perforated belts 30, 30'.

In FIG. 4, the centrally arranged perforated belt 30 and the two perforated belts 30' arranged to the side thereof, with the associated drive rollers 80 and deflexion rollers 82, as well as the vacuum pans 74, 74' assigned to the particular segments 72, 72', are shown in perspective representation. The machine frame provided with a casing—compare FIGS. 1 to 3—on which the drive rollers 80, deflexion rollers 82 and the further rollers mentioned further below are mounted and to which the vacuum pans 74, 74' are fastened, is not represented.

Figure 5:
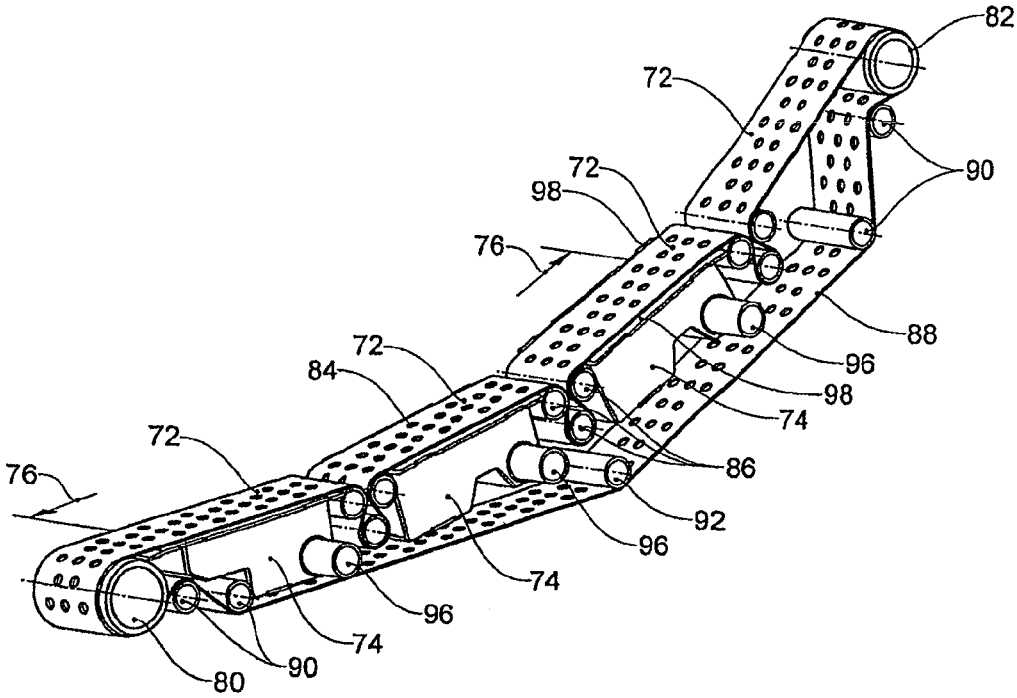
FIG. 5 shows in perspective representation the middle perforated belt of the vacuum belt conveyor, with associated vacuum pans.
Figure 7:
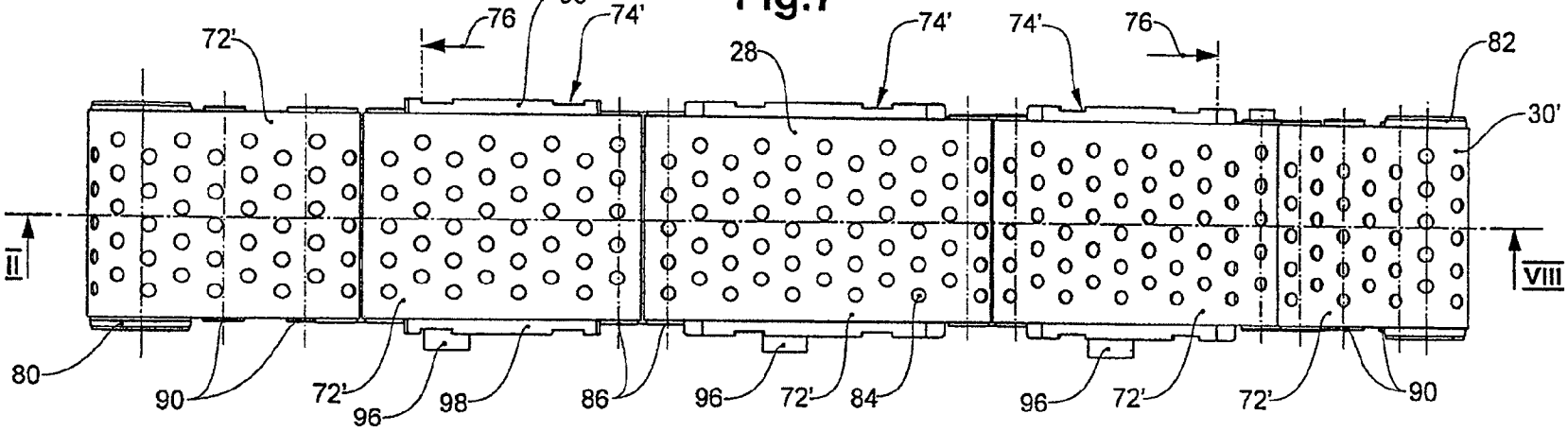
FIG. 7 shows in top view one of the outer perforated belts of the vacuum belt conveyor, with associated vacuum pans.
Figure 9:
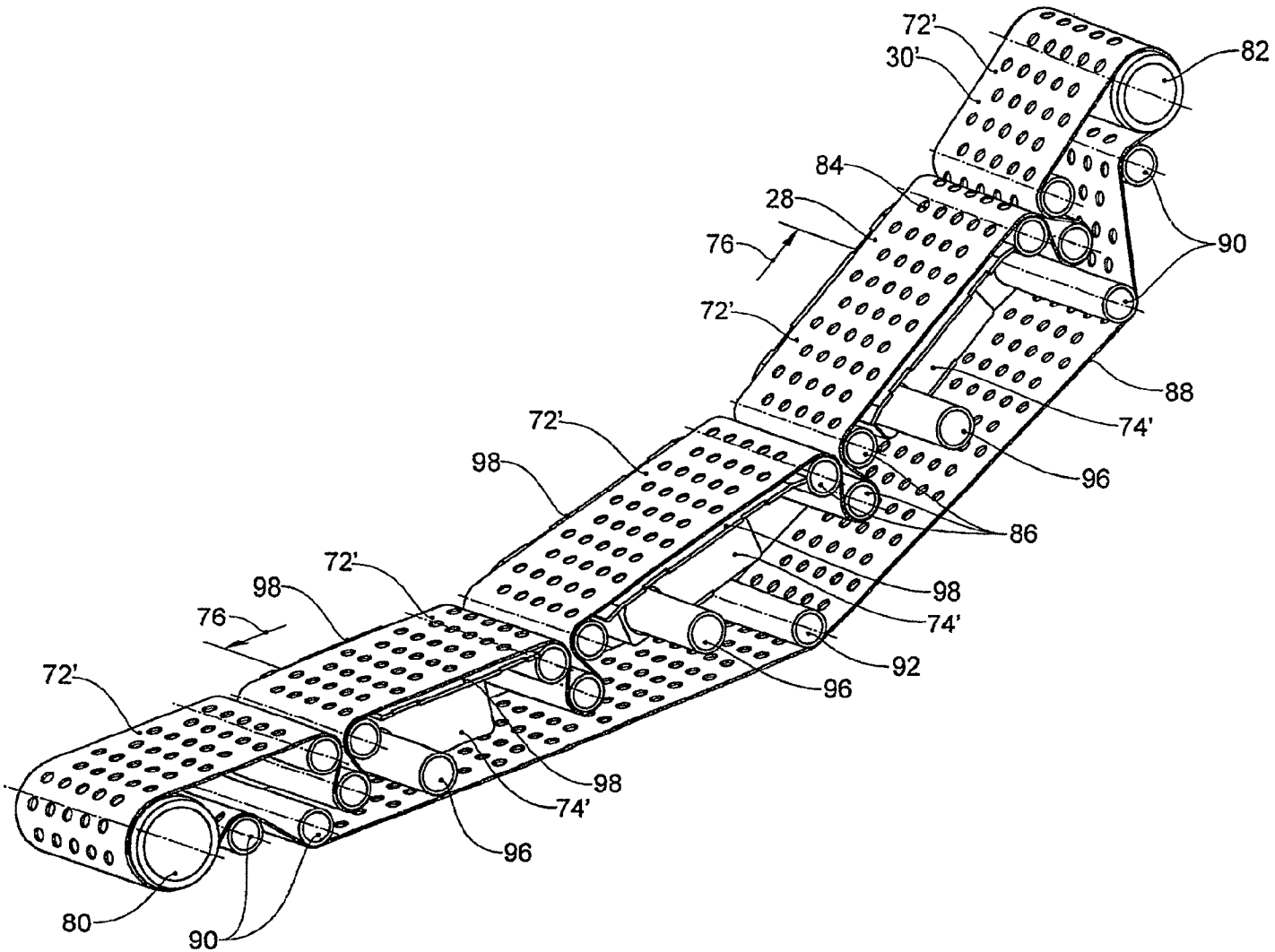
FIG. 9 shows in perspective representation the perforated belt, with the associated vacuum pans, according to FIGS. 7 and 8.

The endless perforated belt 30—see also FIG. 5—and the endless further perforated belts 30'—compare also FIGS. 7 and 9—are provided with a continuous hole pattern, so that a multiplicity of continuous suction holes 84 are always present in the region of the vacuum pans 74, 74'. In the present case, the perforated belts 30, 30' are provided with transverse rows of suction holes 84, which rows are arranged successively one behind another in the direction of rotation U, a plurality of such rows respectively being located in the region of each vacuum pan 74, 74'.

Figure 6:
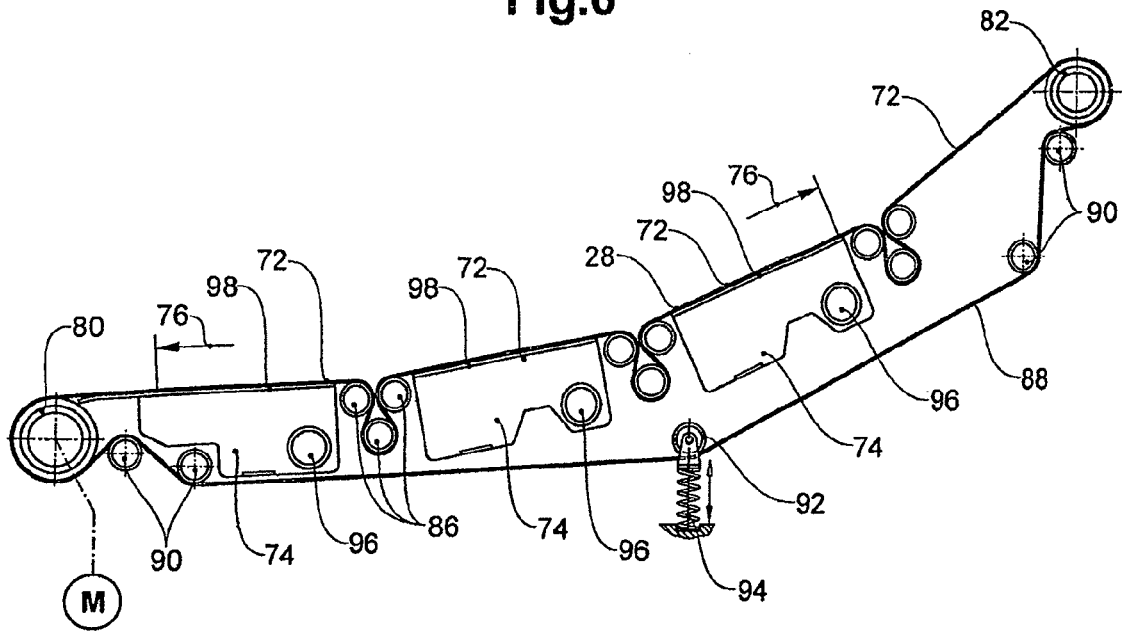
FIG. 6 shows in side view the middle perforated belt, with the associated vacuum pans.
Figure 8:
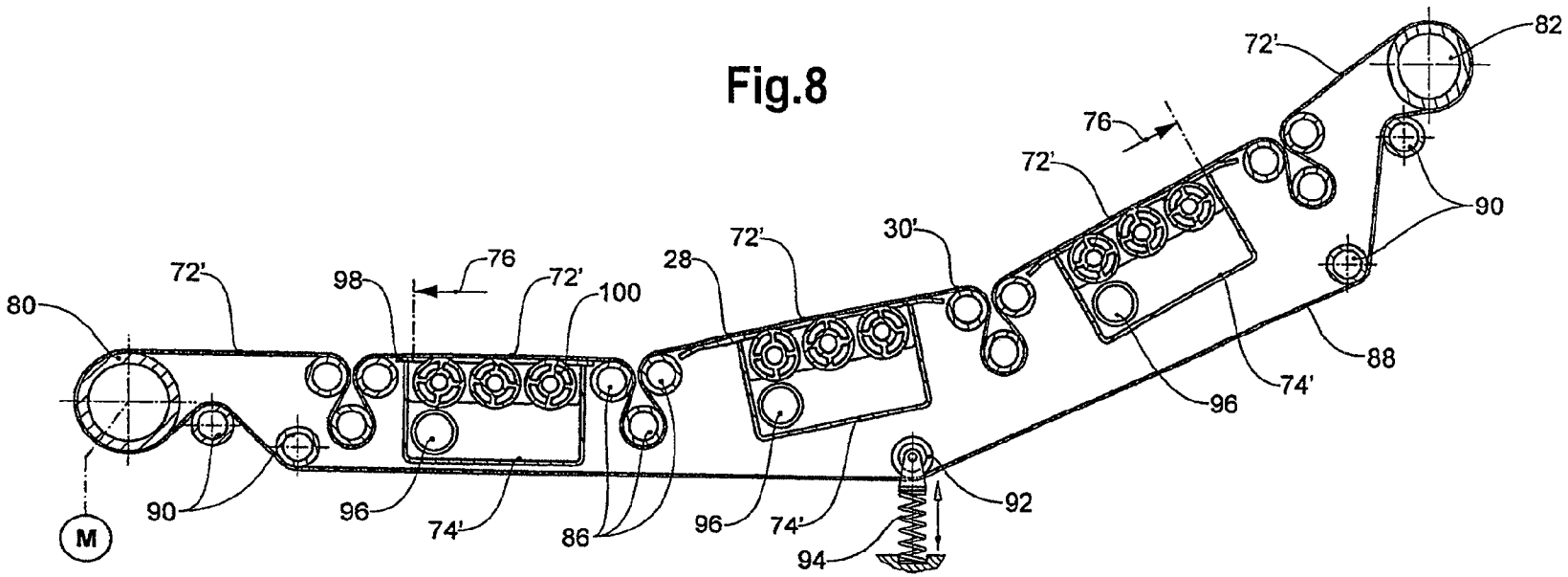
FIG. 8 shows in a section along the line VIII-VIII of FIG. 7 the perforated belt which is shown there, with the corresponding vacuum pans.

Both the perforated belt 30 and the further perforated belts 30' are guided at the upstream-situated end around deflexion rollers 82, which are mounted coaxially in a freely rotatable manner, and at the downstream-situated end around drive rollers 80, which are likewise coaxially mounted, yet are connected to one another and to a drive motor M—see FIGS. 6 and 8. Between two respectively successive segments 72, 72', the perforated belts 30, 30' are respectively deflected in a Ω-like manner around three further deflexion rollers 86, which have parallel axes, are arranged in the isosceles triangle and are mounted such that they are freely rotatable. Two of these three further deflexion rollers 86, viewed in the direction of conveyance F, are respectively arranged directly one after the other, the upstream-situated one of these further deflexion rollers 86 being arranged close to the downstream-situated end of a segment 72, 72' and the adjacent deflexion roller 82 being arranged at the upstream-situated end of the following segment 72, 72'. The third of these further deflexion rollers 86 is arranged such that it is offset, with respect to the two others, downward in the direction of the return strand 88.

The return strand 88 of each perforated belt 30, 30' is guided adjacent to the particular drive roller 80 and adjacent to the associated deflexion roller 82 in an S-shape around a roller pair 90 in order, on the one hand, to increase the angle of wrap about the drive roller 80 or deflexion roller 82 and, on the other hand, to increase the distance of the return strand 88 to the active strand 28 and make space for the vacuum pans 74, 74' arranged therebetween. Roughly midway between these roller pairs 90, the perforated belt 30 and the further perforated belts 30' are guided around a respective tensioning roller 92 in order to keep the perforated belts 30, 30' taut. Acting between the machine frame and the tensioning rollers 92 is a respective tension spring 94, see FIGS. 6 and 8.

The vacuum pans 74, 74' are connected by a piping 96 to a commonly known vacuum source (not shown). On the side facing the active strand 28, the vacuum pans 74, 74' are open and the perforated belt 30 or the particular further perforated belt 30' runs over this opening. The suction holes 84 respectively located in the region of these openings are connected to the vacuum source.

The vacuum pans 74, 74' each have a planar flange 98, which encircles the opening and protrudes radially outward, which flanges, on the one hand, support the active strand 28 and, on the other hand, prevent false air from being sucked into the vacuum pans 74, 74'. For the sake of completeness, it should be mentioned that the width of the openings of the vacuum pans 74, 74' is less than the width of the associated perforated belt 30, or of the further perforated belt 30'.

In the shown illustrative embodiment, the width of the further perforated belts 30' is greater than the width of the perforated belt 30. Preferably, the vacuum pans 74' assigned to the further perforated belts 30' are provided with supporting rollers 100, mounted in a freely rotatable manner, to prevent the particular regions of the further perforated belts 30' from being sucked into the vacuum pans 74'. As can be deduced, in particular, from FIG. 8, each particular vacuum pan 74' can be assigned, for example, three supporting rollers 100, which extend over at least a part of the width of the opening of the vacuum pans 74' and are seated in a freely rotatable manner on bearing shafts, which latter extend at right angles to the direction of conveyance F and direction of rotation U through the vacuum pans 74' and are fastened to the side walls thereof. The supporting rollers 100 can be narrowly configured, so that they rather form supporting wheels. Naturally, it is also possible to arrange a plurality of narrow supporting rollers 100 or supporting wheels side by side on a bearing shaft. It is also conceivable, of course, to provide supporting rollers 100 in the vacuum pans 74 assigned to the perforated belt 30.

The radius with which the guide channel 60 is curved in the transfer portion 22 can measure, for example, about 500 mm. The deflexion and drive wheel 66 can have a radius of, for example, 250 mm. On the conveying member 58, the carrying members 56 are arranged, for example, with a center-to-center spacing of 100 mm. Furthermore, the grippers 24 can be controlled in their pivotal position such that the motional path 38 in the transfer portion 22 has a radius of about 600 mm. If the distance between the motional path 38 of the gripper jaws 16 and the active strand 28 of the vacuum belt conveyor 26 here amounts to a distance A of about 75 mm, the products 10 are taken up by the gripper conveyor with a distance of 135 mm between the end edges 32' of successive products 10 and carried off in the direction of evacuation W. In the rectilinear portions of the motional path 38, this distance amounted to 100 mm.

If, based on the above-specified dimensions, the conveying member 58 is driven at a rotational velocity of, for example, 1000 mm/s, the gripper jaws 16 move at a speed |v| of 1200 mm/s and the active strand 28 moves at a speed |w| (and rotational velocity) of 1350 mm/s.

The motional path 38 may run in the transfer portion 22 in the shape of a circular arc, the radius of the circular arc for the processing of printed products being in some embodiments less than one meter. The length of the transfer portion 22 measures, for example, between 300 mm and one meter, and can be about 500 mm.

Figure 10:
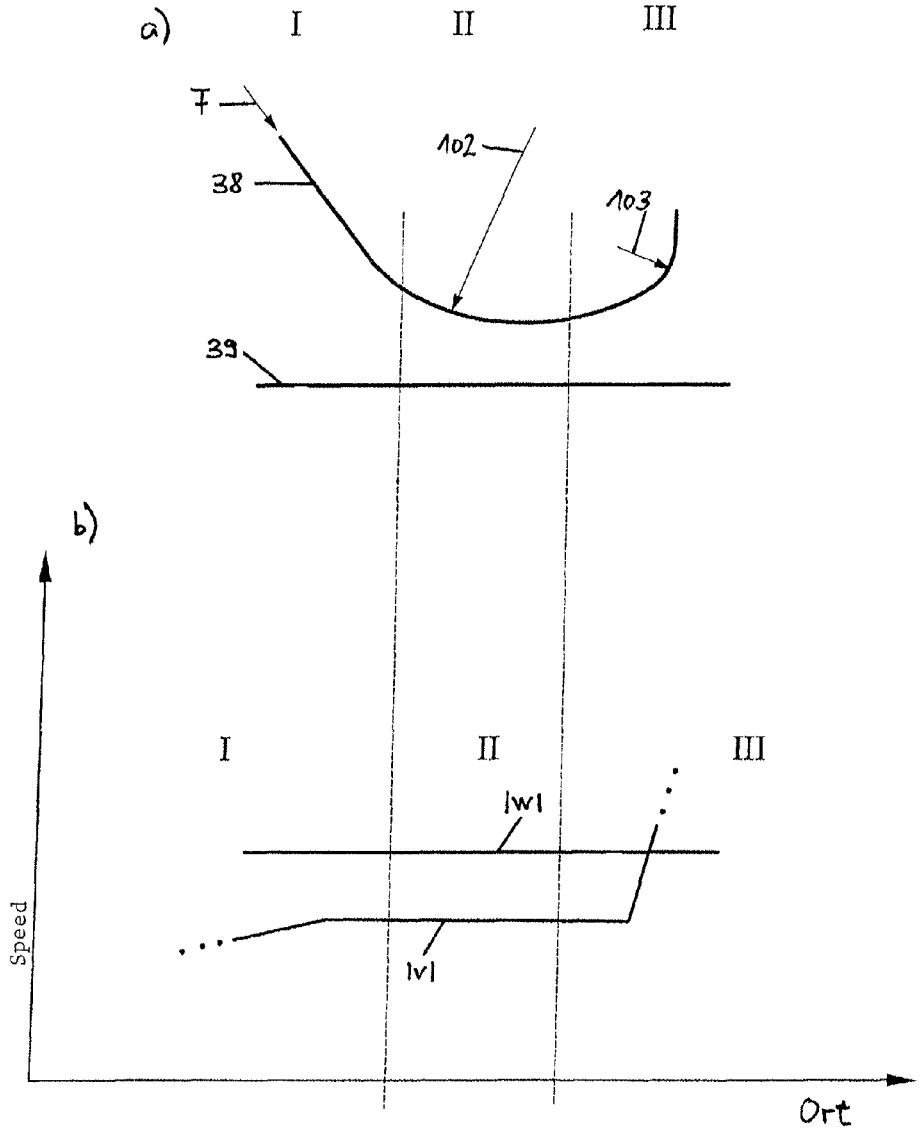
FIG. 10*a* shows, in heavily simplified representation, a first example of a path course of the gripper jaws of the gripper conveyor and of the evacuation conveyor.
FIG. 10*b* shows the speed |w| of the perforated belt and the speed |v| of the gripper jaws in dependence on the location.

In FIG. 10*a*, the course of the motional path 38 of the gripper jaws is shown in heavily simplified representation, the direction of conveyance being denoted by F. In the shown example, the course of the motional path 39 of the active strand of the perforated belt of the vacuum belt conveyor is rectilinear. The course of the motional paths 38 and 39 is here divided into an inlet portion I, a transfer portion II and an outlet portion III. The inlet portion I refers to that part of the motional paths 38 and 39 which leads to the transfer portion II. The outlet portion III refers to that part of the motional paths 38 and 39 which leads away from the transfer portion II. Radii of curvature 102 and 103 of the motional path 38 of the gripper jaws in the transfer portion II and in the outlet portion III respectively are likewise shown. As can be seen from FIG. 10*b*, in the transfer portion II the active strand of the perforated belt is driven at a speed |w| which is greater than the speed |v| of the gripper jaws. In the outlet portion III, a sharp increase in speed |v| occurs due to the smaller radius of curvature 103.

Figure 11:
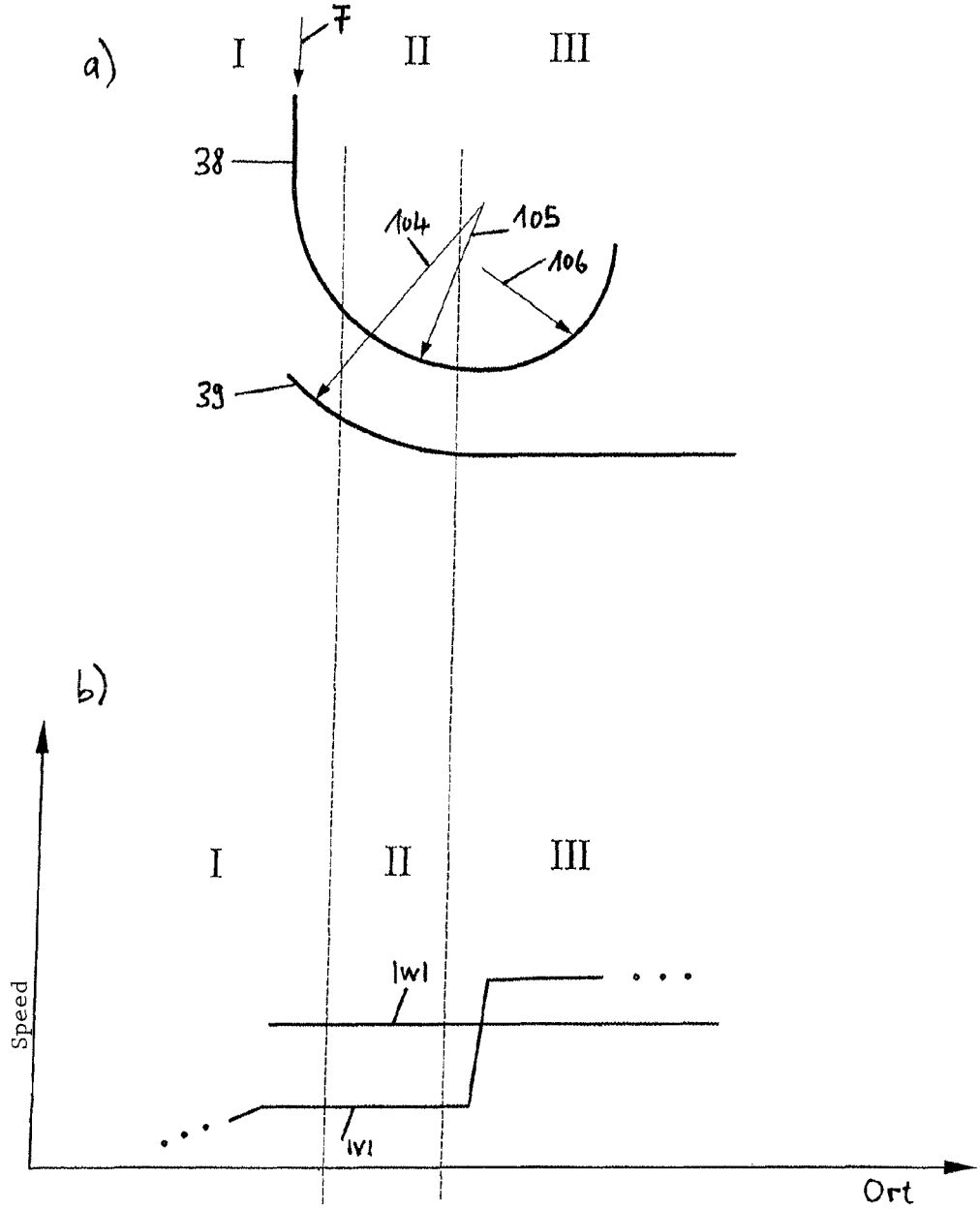
FIG. 11*a* shows, in heavily simplified representation, a second example of a path course of the gripper jaws of the gripper conveyor and of the evacuation conveyor.
FIG. 11*b* shows, once again, the speed |w| of the perforated belt and the speed |v| of the gripper jaws in dependence on the location.

In FIG. 11*a*, a further example of the course of the motional path 38 of the gripper jaws is shown, once again, in heavily simplified representation. The direction of conveyance is denoted by F. In the shown example, the course of the motional path 39 of the active strand of the perforated belt of the vacuum belt conveyor is concavely curved. The course of the motional paths 38 and 39 is here divided into an inlet portion I, a transfer portion II and an outlet portion III. The inlet portion I once again refers to that part of the motional paths 38 and 39 which leads to the transfer portion II. The outlet portion III refers to that part of the motional paths 38 and 39 which leads away from the transfer portion II. The radii of curvature 104, 105 and 106 are likewise shown. As can be seen from FIG. 11*b*, in the transfer portion II the active strand of the perforated belt is driven at a speed |w| which is greater than the speed |v| of the gripper jaws. In the outlet portion III, a sharp increase in speed |v| occurs due to the smaller radius of curvature 106.

Figure 12:
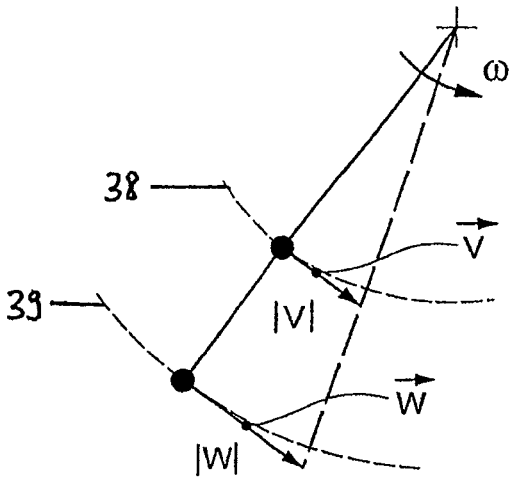
FIG. 12 shows the angular velocity and the velocities v and w or the speeds |v| and |w| at a point on the respective path course.

FIG. 12 illustrates the relationship between the angular velocity and the velocities v and w or the speeds |v| and |w| at a point on the respective path course. Here too, it can be seen that, at the respectively shown point (blackened circle) on the motional paths 38 and 39, the speed |w| of the perforated belt is greater than the speed |v| of the gripper jaws on the motional path 38.

The working method of that embodiment of the apparatus according to the invention which is shown in the figures is as follows. The grippers 14 are continuously driven such that they rotate in the direction of conveyance F. The grippers 14 are each loaded in a loading station with a product 10, the grippers 14, with their gripper jaw 16, respectively grasping the product 10 in its holding region 18 contiguous to the holding edge 20, and securing the same. The grippers 14 are supplied to the transfer portion 22 with a pivotal position such that that free end edge 32' which lies opposite the holding edge 20, and thus the thereto adjoining end region 32, viewed in the direction of conveyance F, is trailing with respect to the holding edge 20. In the direction of the transfer portion 22, the products 10 slide with their end region 32 along the guide rods 70 and then, aided by the centrifugal forces and as a result of the convex course of the motional path 38 of the gripper jaws 16, come to bear with their end region 32 against that active strand 28 of the vacuum belt conveyor 26 which lies radially on the outside with respect to said motional path 38.

In the region of the first segments 72, 72' of the vacuum belt conveyor 26, the end regions 32 of the products 10 are extensively supported, whereby they stabilize. In the adjoining suction portion 76", the end regions 32 are suctioned to the perforated belt 30 and the further perforated belt 30' and are thereby secured. At the end 34 of the transfer portion 22, the grippers 14 which run past there are respectively opened, whereby the particular products 10 are released. Since they are held at this moment by the vacuum belt conveyor 26, they cannot alter their position to the perforated belt 30, 30' and relative to one another. The products 10 are held stable when their holding region 18 is released. Despite an airstream, a stable delivery of the products 10 onto the vacuum belt conveyor 26 with a defined altered spacing between the holding edges 20 of successive products 10 is realized. The stabilized products 10 are released from the vacuum belt conveyor 26 close to the downstream-situated end of the suction portion 76 and are carried off in an ordered formation by means of the downstream belt conveyor 36.

The length of the transfer portion 22, measured in the direction of conveyance F, is greater than the extent of the largest products 10 to be transported. The width of the suction-active region of the vacuum belt conveyor 26, measured at right angles to the direction of conveyance F, is chosen smaller than the width of the, in this regard, smallest products 10 to be transported.

That which is claimed:

1. An apparatus for transporting flexible, planar products, in particular printed products such as newspapers or magazines, comprising a gripper conveyor having grippers that are arranged one behind another and are driven rotatingly in a direction of conveyance (F) along a motional path, each gripper having a gripper jaw for holding and transporting a product by a holding region of the product, a transfer portion, and a vacuum belt conveyor having a perforated belt with an active strand driven in the direction of conveyance (F), wherein, in the transfer portion, the motional path of the gripper jaws has an arc-shaped course and the active strand runs at a distance (A) to the motional path, the perforated belt is driven at a belt speed (|w|) which is greater than the speed (|v|) of the gripper jaws, the products are held by the gripper conveyor in the holding region, and the vacuum belt conveyor is designed to suction the products with the active strand of the perforated belt in an end region facing away from the holding region and to transport the products onward following release by the grippers.

2. The apparatus as claimed in claim 1, wherein, in the transfer portion, the active strand has an at least approximately arc-shaped course which is equidirectional to the motional path.

3. The apparatus as claimed in claim 1, wherein, in the transfer portion, the motional path has a circular-arc shaped course.

4. The apparatus as claimed in claim 1, wherein, in the transfer portion, the distance (A) is at least approximately constant.

5. The apparatus as claimed in claim 1, wherein the distance (A) is adjustable.

6. The apparatus as claimed claim 1, wherein the gripper jaws are pivotable about a gripper axis running transversely to the direction of conveyance (F).

7. The apparatus as claimed claim 1, wherein, in the transfer portion, the motional path of the gripper jaws runs convexly and the active strand of the vacuum belt conveyor runs concavely.

8. The apparatus as claimed in claim 7, wherein, in the transfer portion, the motional path of the gripper jaws runs radially on the outside with respect to a conveying member, in particular a link chain, on which conveying member they are disposed.

9. The apparatus as claimed in claim 7, wherein, in the transfer portion, the active strand has rectilinear segments (72, 72') which follow one after another in the direction of conveyance (F).

10. The apparatus as claimed in claim 9, wherein at least some of the segments are assigned vacuum pans, which are connected to a vacuum source and over which runs the active strand.

11. The apparatus as claimed in claim 9, wherein the perforated belt is guided between successive segments around deflexion rollers.

12. The apparatus as claimed in claim 1, wherein the vacuum belt conveyor has, in addition to the perforated belt, at least one further perforated belt driven at the same velocity, if necessary the segments of the further perforated belt being arranged offset, in the direction of conveyance (F), in relation to the segments of the perforated belt.

13. A method for transporting flexible, planar products, in particular printed products such as newspapers or magazines, in which a product is transported by a gripper conveyor and by a vacuum belt conveyor, said gripper conveyor having grippers with a gripper jaw that transports the product by securement of a holding region of the product in the gripper jaw, the grippers being arranged one behind another and being driven rotatingly in a direction of conveyance (F) along a motional path, the motional path of the grippers being of arc-shaped course, and the vacuum belt conveyor having a perforated belt with an active strand driven in the direction of conveyance (F), wherein the product is conveyed into a transfer portion by the gripper conveyor, and in the transfer portion, the active strand runs at a distance (A) to the motional path of the gripper jaws, the perforated belt is driven at a belt speed (|w|) greater than the speed (|v|) of the gripper jaws, and, the product is suctioned in an end region facing away from the holding region, by the active strand of the perforated belt, and is transported onward following release by the grippers.

14. The method as claimed in claim 13, wherein, in the transfer portion, the active strand runs in the same direction as the motional path and at least approximately in an arc shape.

15. The method as claimed in claim 13, wherein, in the transfer portion, the motional path runs in the shape of a circular arc.

16. The method as claimed in claim 13, wherein the motional path of the gripper jaws runs convexly and the active strand of the vacuum belt conveyor runs concavely.

* * * * *